US012402712B2

(12) United States Patent
Ishida

(10) Patent No.: US 12,402,712 B2
(45) Date of Patent: Sep. 2, 2025

(54) COSMETIC CONTAINER PACKAGE

(71) Applicant: TOKIWA CORPORATION, Nakatsugawa (JP)

(72) Inventor: Yukikazu Ishida, Kawaguchi (JP)

(73) Assignee: TOKIWA CORPORATION, Nakatsugawa (JP)

( * ) Notice: Subject to any disclaimer, the term of this patent is extended or adjusted under 35 U.S.C. 154(b) by 0 days.

(21) Appl. No.: 18/197,218

(22) Filed: May 15, 2023

(65) Prior Publication Data

US 2023/0363514 A1 Nov. 16, 2023

(30) Foreign Application Priority Data

May 16, 2022 (JP) ..... 2022-080237

(51) Int. Cl.

| | |
|---|---|
| ***A45D 40/12*** | (2006.01) |
| ***B65D 75/30*** | (2006.01) |
| ***B65D 75/58*** | (2006.01) |
| *A45D 40/06* | (2006.01) |

(52) U.S. Cl.

CPC ..... *A45D 40/12* (2013.01); *B65D 75/30* (2013.01); *B65D 75/5805* (2013.01); *A45D 40/06* (2013.01)

(58) Field of Classification Search

CPC ..... A45D 40/06; A45D 40/12; B65D 75/30; B65D 75/5805

USPC ..... 383/200

See application file for complete search history.

(56) References Cited

U.S. PATENT DOCUMENTS

| | | | | |
|---|---|---|---|---|
| 3,341,006 | A * | 9/1967 | Bindler | B65D 75/36 206/461 |
| 5,018,893 | A * | 5/1991 | Holloway | A45D 40/04 401/175 |
| 2017/0265626 | A1* | 9/2017 | Earl | A45D 40/04 |
| 2017/0296776 | A1* | 10/2017 | Palmer | A61M 25/002 |
| 2017/0326908 | A1* | 11/2017 | Martin | A46B 17/04 |
| 2018/0008026 | A1* | 1/2018 | Kuo | A45D 40/12 |
| 2018/0008027 | A1* | 1/2018 | Yeung | A45D 40/205 |
| 2018/0020809 | A1* | 1/2018 | Soga | A45D 40/06 401/88 |
| 2022/0202164 | A1* | 6/2022 | Banks | A45D 34/04 |

FOREIGN PATENT DOCUMENTS

JP 2021-087685 A 6/2021

* cited by examiner

*Primary Examiner* — Peter N Helvey

(74) *Attorney, Agent, or Firm* — PROCOPIO, CORY, HARGREAVES & SAVITCH LLP

(57) ABSTRACT

A cosmetic container package includes: a stick-shaped cosmetic material container that accommodates a stick-shaped cosmetic material inside and allows the stick-shaped cosmetic material to come out from an opening provided at a tip end; and a packaging body that sandwiches and packages the stick-shaped cosmetic material container with a film. The packaging body includes a welding portion that seals the stick-shaped cosmetic material container up to the vicinity of an outer periphery by welding the film together. The welding portion further includes a tip end side annular portion that annularly adheres to the outer periphery of the stick-shaped cosmetic material container in the vicinity of the opening.

7 Claims, 5 Drawing Sheets

COSMETIC CONTAINER PACKAGE

REFERENCE TO RELATED APPLICATIONS

This application claims priority from Japanese Patent Application No. 2022-080237 filed on May 16, 2022. The entire content of the priority application is incorporated herein by reference.

TECHNICAL FIELD

The present disclosure relates to a cosmetic container package.

BACKGROUND ART

In the related art, JP2021-087685A discloses a cosmetic product in which a cosmetic material and an applicator are sandwiched between opposing films, and this cosmetic product is a simple container as a promotional sample or the like, in which vicinities of the cosmetic material and the applicator are welded together to integrate the cosmetic material and the applicator to ensure airtightness, and the film is unsealed before use.

SUMMARY OF INVENTION

In recent years, there has been a demand for an ecological stick-shaped cosmetic material container, which can reduce the number of parts as much as possible while maintaining the conventional quality, and which can reuse previously used parts.

Therefore, one of objects of the present disclosure is to provide an ecological cosmetic container package, which can reduce the number of parts while maintaining high airtightness until unsealing, and which can reuse previously used parts.

According to a first aspect of the present disclosure, there is provided a cosmetic container package including: a stick-shaped cosmetic material container that accommodates a stick-shaped cosmetic material inside and allows the stick-shaped cosmetic material to come out from an opening provided at a tip end; and a packaging body that sandwiches and packages the stick-shaped cosmetic material container with a film, wherein the packaging body includes a welding portion that seals the stick-shaped cosmetic material container up to the vicinity of an outer periphery by welding the film together, and wherein the welding portion further includes a tip end side annular portion that annularly adheres to the outer periphery of the stick-shaped cosmetic material container in the vicinity of the opening.

According to the first aspect, since the stick-shaped cosmetic material container is sealed at the welding portion of the film, the stick-shaped cosmetic material container can be sold without a cap, and the number of parts can be reduced, which is ecological. In addition, since the opening side of the tip end of the stick-shaped cosmetic material container is sealed with the tip end side annular portion of the welding portion of the film, high airtightness can be maintained until unsealing. In addition, when the packaging body is unsealed and the stick-shaped cosmetic material container is taken out and used, the previously used cap and the container main body having a built-in feeding mechanism for feeding the stick-shaped cosmetic material can be reused, which is ecological.

According to a second aspect of the present disclosure, there is provided an annular cosmetic container package according to the first aspect, wherein the welding portion of the film includes an annular retraction stopper that suppresses retraction of the stick-shaped cosmetic material container behind the tip end side annular portion.

According to the second aspect, the push-back of the stick-shaped cosmetic material container rearward can be suppressed by the retraction stopper provided behind the tip end side annular portion, and the opening side of the tip end of the stick-shaped cosmetic material container can be reliably sealed.

According to a third aspect of the present disclosure, there is provided a cosmetic container package according to the second aspect, wherein the stick-shaped cosmetic material container is provided with an annular flange portion protruding along a peripheral direction from an outer peripheral surface behind the tip end side annular portion, and wherein the retraction stopper is provided as a rear end side annular portion at a position overlapping the flange portion in an axial direction behind the flange portion.

According to the third aspect, the actions and advantages of the second aspect can be reliably realized.

According to a fourth aspect of the present disclosure, there is provided a cosmetic container package according to the third aspect, wherein a tail plug is provided at a rear end of a stick-shaped cosmetic material hole of the stick-shaped cosmetic material container through which the stick-shaped cosmetic material passes, the tail plug being configured to detachably close the stick-shaped cosmetic material hole, and wherein a notch for unsealing the packaging body is provided at a position where a rear end portion of the stick-shaped cosmetic material container is exposable behind the rear end side annular portion.

According to the fourth aspect, when replacing a stick-shaped cosmetic material container with a stick-shaped cosmetic material container in an unopened packaging body for the purpose of changing the color of the stick-shaped cosmetic material, or the like, the stick-shaped cosmetic material container is inserted into the unsealed packaging body and a tail plug is attached thereto, and the rear end side annular portion is used as a retraction stopper and can be used instead of a cap. In addition, since the rear end portion of the stick-shaped cosmetic material container is exposed from the unsealed packaging body, it is easy to grasp and easy to take in and out the stick-shaped cosmetic material container with respect to the unsealed packaging body that serves as a cap. Further, the tail plug can further enhance the airtightness before unsealing.

According to a fifth aspect of the present disclosure, there is provided a cosmetic container package according to the first aspect, wherein the stick-shaped cosmetic material container includes a container main body having a built-in feeding mechanism for feeding the stick-shaped cosmetic material.

According to the fifth aspect, substantially the same actions and advantages as those of the first aspect are obtained. That is, since the stick-shaped cosmetic material container is sealed at the welding portion of the film, the stick-shaped cosmetic material container can be sold without a cap, and the number of parts can be reduced, which is ecological. In addition, since the opening side of the tip end of the stick-shaped cosmetic material container is sealed with the tip end side annular portion of the welding portion of the film, high airtightness can be maintained until unsealing. In addition, when the packaging body is unsealed and the stick-shaped cosmetic material container is taken out and used, the previously used cap can be reused because the container main body having a built-in feeding mechanism is provided, which is ecological.

According to a sixth aspect of the present disclosure, there is provided a cosmetic container package according to the fifth aspect, wherein the welding portion of the film includes an annular retraction stopper that suppresses retraction of the stick-shaped cosmetic material container behind the tip end side annular portion, and wherein a notch for unsealing the packaging body is provided behind the retraction stopper.

According to the sixth aspect, the push-back of the stick-shaped cosmetic material container rearward can be suppressed by the retraction stopper provided behind the tip end side annular portion, and the opening side of the tip end of the stick-shaped cosmetic material container can be reliably sealed. In addition, when replacing the stick-shaped cosmetic material container with the stick-shaped cosmetic material container in an unopened packaging body for the purpose of changing the color of the stick-shaped cosmetic material, or the like, the stick-shaped cosmetic material container is inserted into the unsealed packaging body. Accordingly, the retraction of the stick-shaped cosmetic material container can be suppressed by the retraction stopper while securing airtightness, and the unsealed packaging body can be used as a cap for the stick-shaped cosmetic material container.

According to a seventh aspect of the present disclosure, there is provided a cosmetic container package according to the sixth aspect, wherein the notch is provided at a position where a rear end portion of the stick-shaped cosmetic material container is exposable.

According to the seventh aspect, since the rear end portion of the stick-shaped cosmetic material container is exposed from the unsealed packaging body, it is easy to grasp and easy to take in and out the stick-shaped cosmetic material container with respect to the unsealed packaging body that serves as a cap.

According to the aspects of the present disclosure as described above, it is possible to provide an ecological cosmetic container package, which can reduce the number of parts while maintaining high airtightness until unsealing, and which can reuse previously used parts.

DESCRIPTION OF EMBODIMENTS

Figure 1:
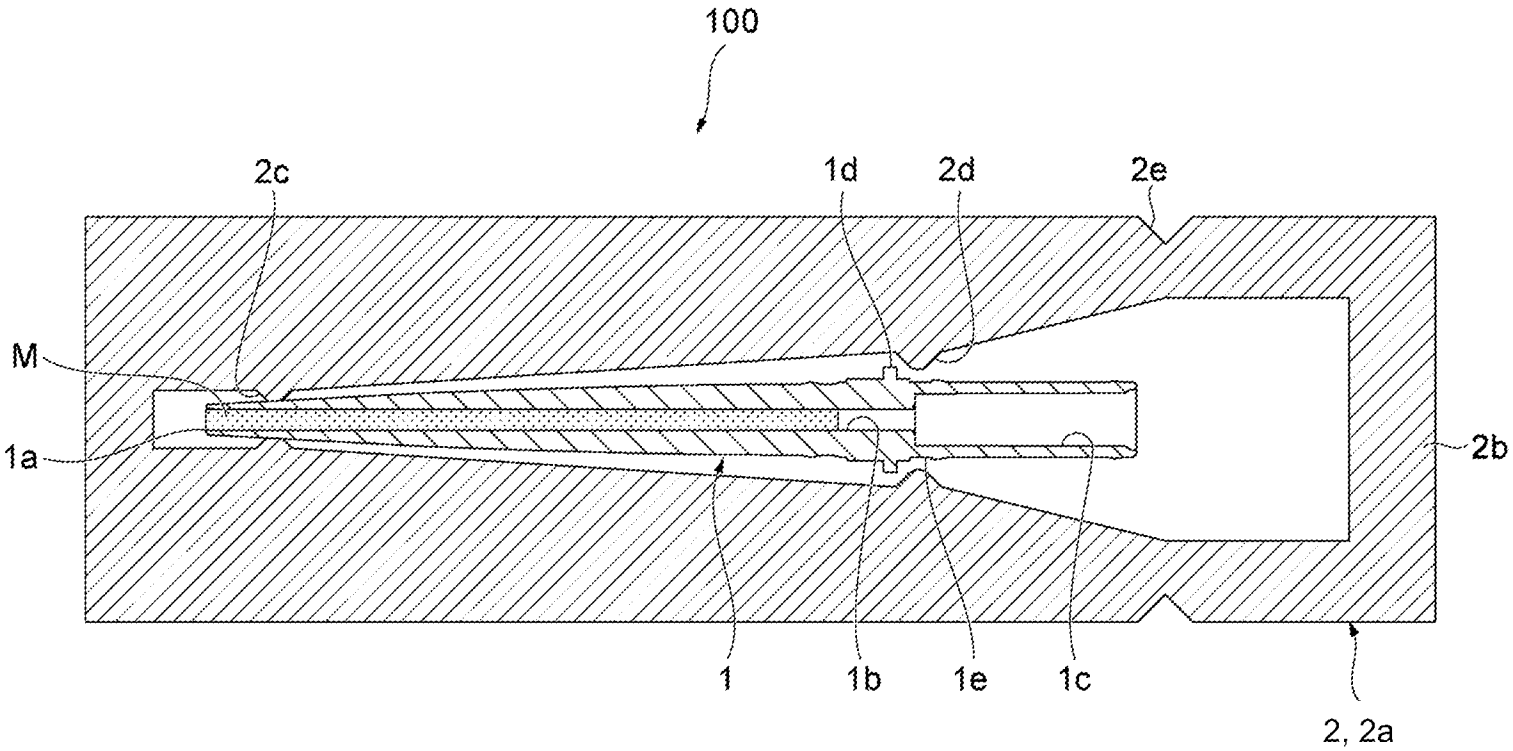
FIG. 1 is a longitudinal sectional view showing a cosmetic container package according to a first embodiment of the present disclosure.
Figure 2:
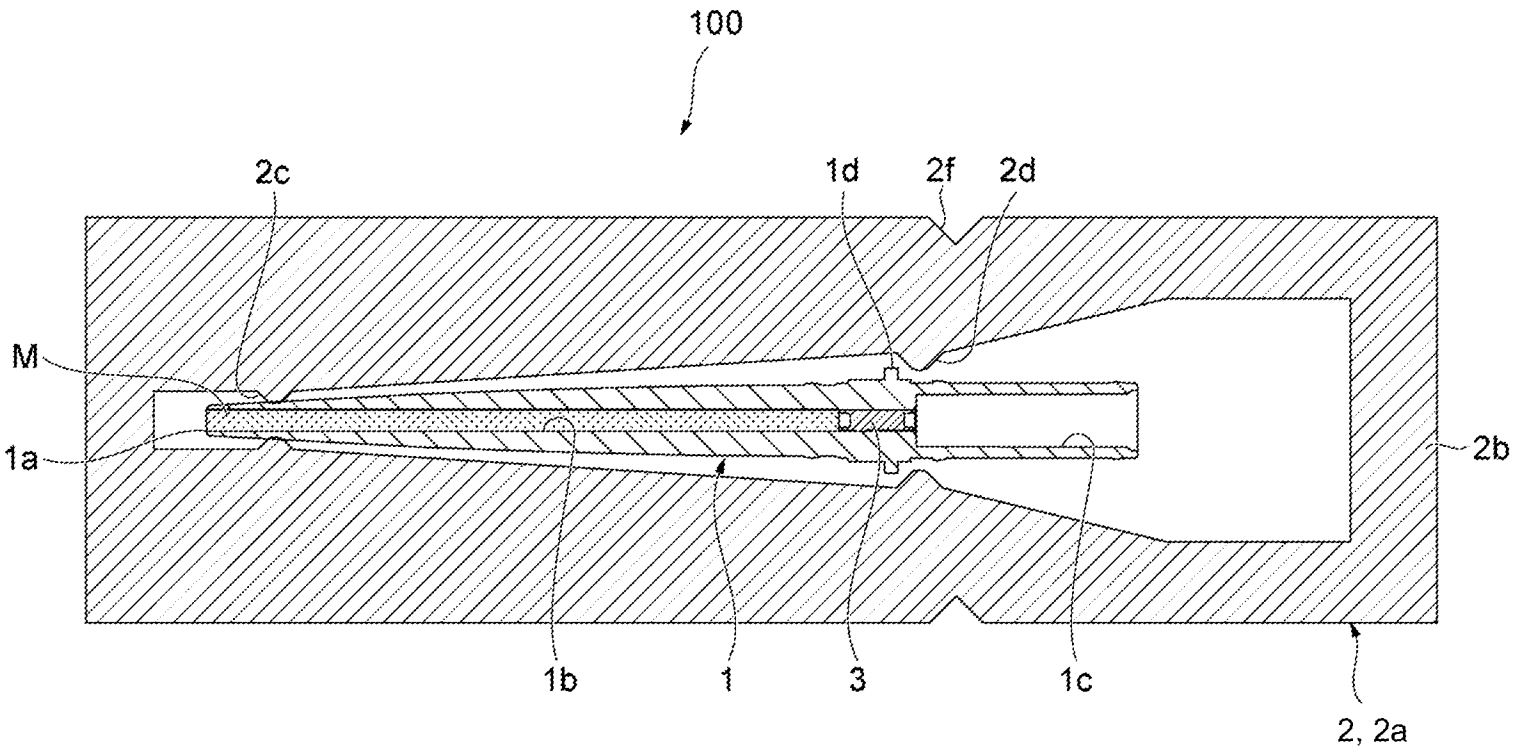
FIG. 2 is a longitudinal sectional view showing a cosmetic container package according to a second embodiment of the present disclosure.
Figure 3:
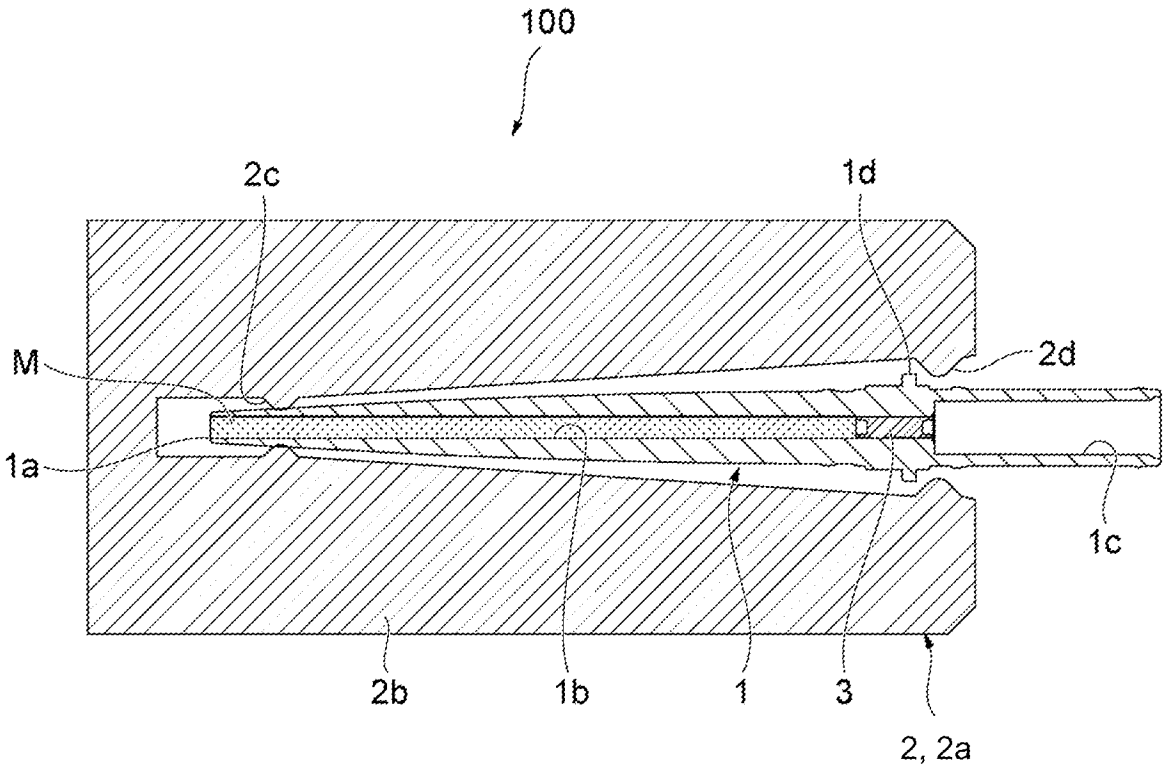
FIG. 3 is a longitudinal sectional view for explaining actions and advantages of the cosmetic container package according to the second embodiment of the present disclosure.
Figure 4:
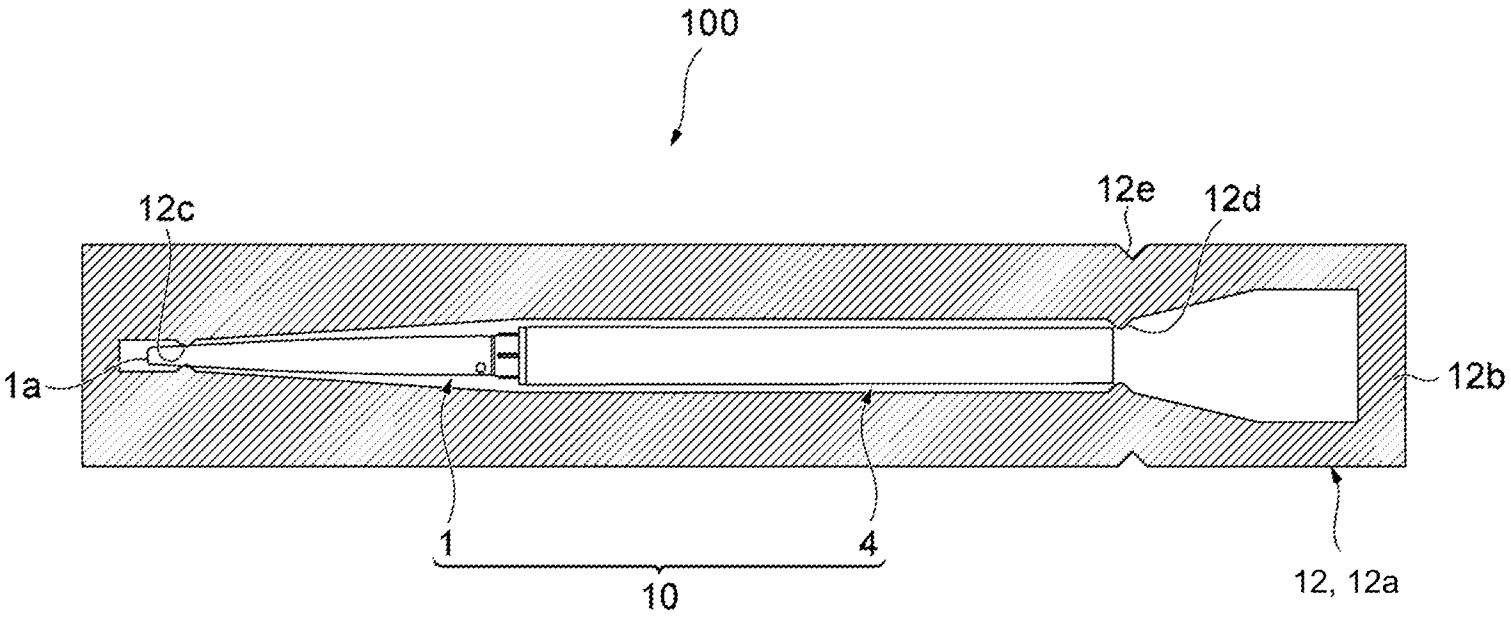
FIG. 4 is a longitudinal sectional view showing a cosmetic container package according to a third embodiment of the present disclosure.
Figure 5:
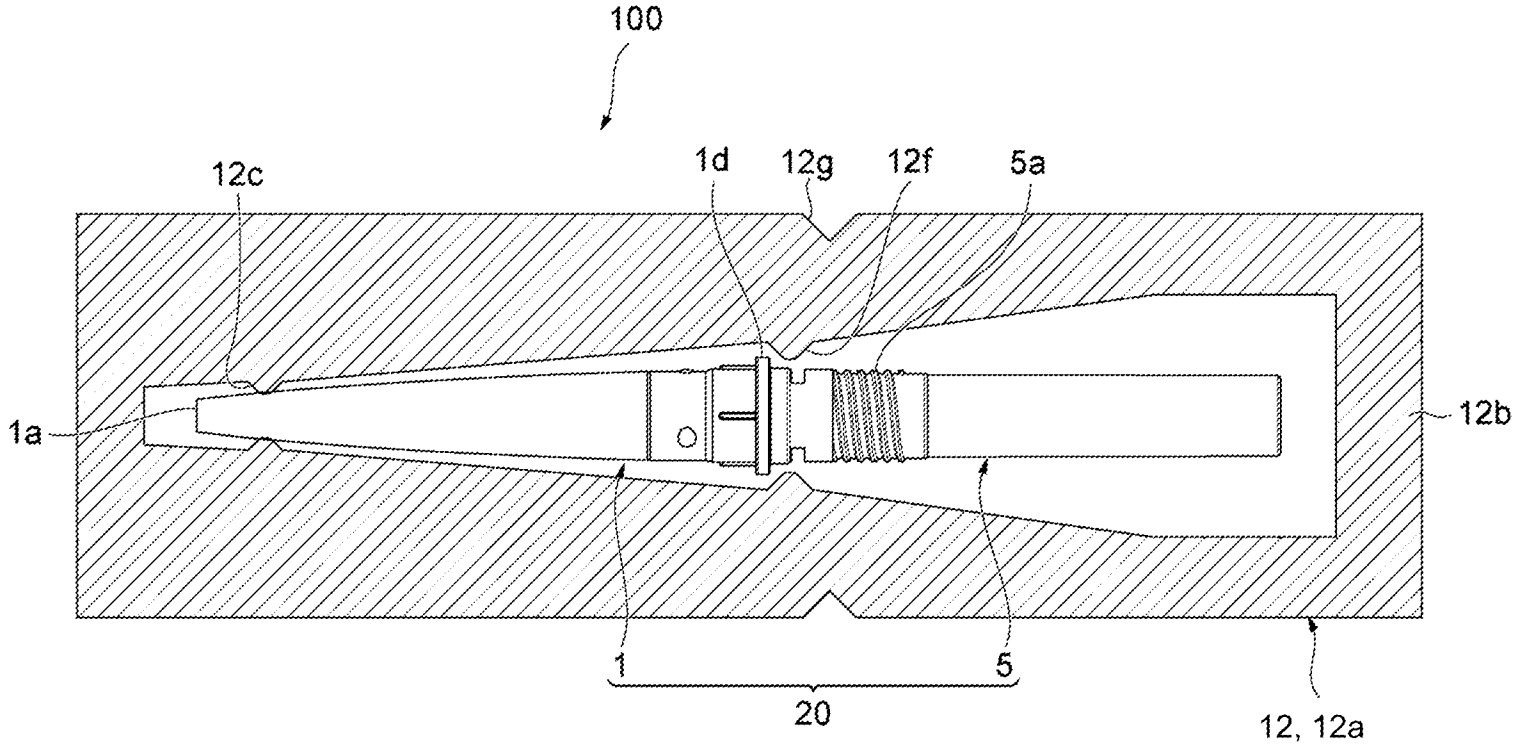
FIG. 5 is a longitudinal sectional view showing a cosmetic container package according to a fourth embodiment of the present disclosure.

Preferred embodiments of a cosmetic container package according to the present disclosure will be described below with reference to FIGS. 1 to 5. FIG. 1 shows a first embodiment of the present disclosure, FIG. 2 shows a second embodiment of the present disclosure, FIG. 3 is a view showing actions and advantages of the second embodiment of the present disclosure, FIG. 4 is a view showing a third embodiment of the present disclosure, and FIG. 5 shows a fourth embodiment of the present disclosure. In each of the drawings, the same elements will be denoted by the same reference numerals, and overlapping descriptions thereof will be omitted.

First, the first embodiment shown in FIG. 1 will be described. FIG. 1 is a longitudinal sectional view showing a cosmetic container package 100 according to the first embodiment of the present disclosure.

The cosmetic container package 100 according to the first embodiment, as shown in FIG. 1, includes a stick-shaped cosmetic material container 1 and a packaging body 2. The stick-shaped cosmetic material container 1 accommodates a stick-shaped cosmetic material M inside and allows the stick-shaped cosmetic material M to come out from an opening 1*a* provided at a tip end. The packaging body 2 includes an opposing film 2*a* and 2*a* that face each other in a direction perpendicular to the sheet of the drawing and sandwiches and packages the stick-shaped cosmetic material container 1.

The stick-shaped cosmetic material container 1 is formed in a tapered cylindrical shape, and is referred to as a so-called tip tube that configures the container front portion of a stick-shaped cosmetic material feeding container for accommodating the stick-shaped cosmetic material M and feeding the stick-shaped cosmetic material M. As the cylindrical shape of the stick-shaped cosmetic material container 1, for example, a cylindrical cross section, an elliptical cylindrical cross section, a polygonal cylindrical cross section, or the like can be appropriately adopted. In addition, eyeliner, eyebrow, lip liner, and the like can be appropriately adopted as the stick-shaped cosmetic material M, and as the shape of the stick-shaped cosmetic material M, for example, a circular cross section, an elliptical cross section, or a polygonal cross section, or the like can also be appropriately adopted.

A stick-shaped cosmetic material hole 1*b* that accommodates the stick-shaped cosmetic material M and through which the stick-shaped cosmetic material M passes, extends from the opening 1*a* toward a rear portion of the stick-shaped cosmetic material container 1, and at the rear portion of the stick-shaped cosmetic material container 1, an enlarged diameter hole 1*c* is provided which communicates with the stick-shaped cosmetic material hole 1*b* and which is enlarged in diameter and opened rearward. The enlarged diameter hole 1*c* serves as a space for accommodating a so-called feeding mechanism that enables feeding of the stick-shaped cosmetic material M.

In addition, on the outer peripheral surface slightly in front of the enlarged diameter hole 1*c* in the stick-shaped cosmetic material container 1, an annular flange portion 1*d* protruding in the peripheral direction is provided to suppress the retraction of the stick-shaped cosmetic material container 1.

On the outer peripheral surface slightly behind the flange portion 1*d* in the stick-shaped cosmetic material container 1, a recess portion 1*e* for mounting a so-called container main body having a bottomed cylindrical shape, which configures the container rear portion of the stick-shaped cosmetic material feeding container, rotatably and immovably in an axial direction, is provided in an annular shape. This container main body has a built-in feeding mechanism for feeding the stick-shaped cosmetic material M.

When the recess portion 1*e* of the stick-shaped cosmetic material container 1 is mounted rotatably and immovably in the axial direction on the front side of the container main body, and is rotated relative to each other, for example, the screwing action of a feeding mechanism having a male screw projection and a female screw projection works, and a piston as a moving body is fed and the stick-shaped cosmetic material M is fed. Instead of the piston, a core chuck that grips the stick-shaped cosmetic material M with a plurality of gripping pieces may be used. In this case, a plurality of gripping piece grooves that allow the movement of the gripping piece are continuously provided around the stick-shaped cosmetic material hole 1*b*.

The packaging body 2 has a welding portion 2*b* that seals the stick-shaped cosmetic material container 1 up to the vicinity of the outer periphery by welding the opposing film 2*a* and 2*a* together.

At the welding portion 2*b*, a tip end side annular portion 2*c* that annularly adheres to the outer periphery of the stick-shaped cosmetic material container in the vicinity of the opening 1*a* is provided for airtightness of the stick-shaped cosmetic material M.

In addition, the welding portion 2*b* has an annular retraction stopper 2*d* that suppresses the retraction of the stick-shaped cosmetic material container 1 behind the tip end side annular portion 2*c*. Here, the retraction stopper 2*d* is provided as a rear end side annular portion at a position overlapping the flange portion 1*d* in the axial direction behind the flange portion 1*d* of the stick-shaped cosmetic material container 1. The rear end side annular portion 2*d* as the retraction stopper may or may not be in contact with the stick-shaped cosmetic material container 1.

In addition, at the welding portion 2*b*, a notch (cut) 2*e* for unsealing the packaging body 2 is provided at a position facing the rear end portion of the packaging body 2. Here, when the notch 2*e* is provided behind the rear end side annular portion 2*d*, and the stick-shaped cosmetic material container 1 is taken out and used, the packaging body 2 may be unsealed using the notch 2*e* as a boundary.

In the cosmetic container package 100 according to the first embodiment configured as described above, since the stick-shaped cosmetic material container 1 is sealed at the welding portion 2*b* of the film 2*a*, the stick-shaped cosmetic material container 1 can be sold without a cap, and the number of parts can be reduced, which is ecological. In addition, since the opening 1*a* side of the tip end of the stick-shaped cosmetic material container 1 is sealed with the tip end side annular portion 2*c* of the welded portion 2*b* of the film 2*a*, high airtightness can be maintained until unsealing. Further, when the packaging body 2 is unsealed and the stick-shaped cosmetic material container 1 is taken out and used, the previously used cap and the container main body having a built-in feeding mechanism for feeding the stick-shaped cosmetic material M can be reused, which is ecological.

In addition, since the welding portion 2*b* of the film 2*a* has the annular retraction stopper 2*d* that suppresses the retraction of the stick-shaped cosmetic material container 1 behind the tip end side annular portion 2*c*, the push-back of the stick-shaped cosmetic material container 1 rearward can be suppressed, and the opening 1*a* side of the tip end of the stick-shaped cosmetic material container 1 can be reliably sealed.

In particular, since the retraction stopper 2*d* is provided as the rear end side annular portion at a position overlapping the flange portion 1*d* in the axial direction behind the flange portion 1*d* of the stick-shaped cosmetic material container 1, the actions and advantages of the above-described sealing can be reliably realized.

Further, when the stick-shaped cosmetic material container 1 is tapered as in the present embodiment, rearward movement is unlikely to be suppressed by the tip end side annular portion 2*c* that annularly adheres to the outer periphery of the stick-shaped cosmetic material container 1 in the vicinity of the opening 1*a*. Therefore, the retraction stopper (rear end side annular portion) 2*d* is effective.

Incidentally, although the notch 2*e* is provided here as being particularly preferable, the notch 2*e* may not be provided, and unsealing may be performed from anywhere on the welding portion 2*b*, for example, with scissors or the like.

FIG. 2 is a longitudinal sectional view showing a cosmetic container package 100 according to the second embodiment of the present disclosure, and FIG. 3 is a longitudinal sectional view for explaining actions and advantages of the cosmetic container package 100 according to the second embodiment of the present disclosure.

The first difference between the second embodiment and the first embodiment is that, as shown in FIG. 2, a tail plug 3 is provided at the rear end of the stick-shaped cosmetic material hole 1*b* of the stick-shaped cosmetic material container 1 to detachably close the stick-shaped cosmetic material hole 1*b*. In addition, the second difference between the second embodiment and the first embodiment is that the notch 2*f* for unsealing the packaging body 2 is provided instead of a notch 2*e* at a position where the rear end portion of the stick-shaped cosmetic material container 1 can be exposed behind the rear end side annular portion 2*d*.

According to the second embodiment configured as described above, in addition to the actions and advantages of the first embodiment, when replacing the stick-shaped cosmetic material container 1 with the stick-shaped cosmetic material container in the unopened packaging body 2 for the purpose of changing the color of the stick-shaped cosmetic material M, or the like, as shown in FIG. 3, the stick-shaped cosmetic material container 1 is inserted into the unsealed packaging body 2 and the tail plug 3 is attached thereto, and the rear end side annular portion 2*d* is used as the retraction stopper and can be used instead of a cap. Since the rear end portion of the stick-shaped cosmetic material container 1 is exposed from the unsealed packaging body 2, it is easy to grasp and easy to take in and out the stick-shaped cosmetic material container 1 with respect to the unsealed packaging body 2 that serves as a cap. As shown in FIG. 2, the tail plug 3 can further enhance the airtightness before unsealing.

FIG. 4 is a longitudinal sectional view showing a cosmetic container package 100 according to the third embodiment of the present disclosure.

A cosmetic container package 100 according to the third embodiment of the present disclosure includes, as shown in FIG. 4, a stick-shaped cosmetic material container 10, and a packaging body 12. The stick-shaped cosmetic material container 10 includes a tip tube 1 and a container main body 4. The tip tube 1 corresponds to the stick-shaped cosmetic material container 1 of the first embodiment and serves as a container front portion. The container main body 4 serves as a container rear portion and has a built-in feeding mechanism. The tip tube 1 and the container main body 4 are mounted to be rotatable with respect to each other while maintaining relative positions in the axial direction. The stick-shaped cosmetic material M is fed by the screwing action of the feeding mechanism by relative rotation between the tip tube 1 and the container main body 4. The packaging body 12 packages the stick-shaped cosmetic material container 10 by sandwiching the stick-shaped cosmetic material container 10 with the film 12*a* and 12*a* facing each other, are provided. The stick-shaped cosmetic material container 10 packaged by the packaging body 12 may also be referred to as a so-called stick-shaped cosmetic material feeding container.

The container main body 4 has a bottomed cylindrical shape and is elongated in the axial direction, and the packaging body 12 is also elongated in the axial direction to match the container main body 4.

At a welding portion 12*b* that seals the stick-shaped cosmetic material container 10 up to the vicinity of the outer periphery by welding the film 12*a* and 12*a* together, a tip end side annular portion 12*c* that annularly adheres to the outer periphery of the tip tube 1 in the vicinity of the opening 1*a*, as in the first embodiment.

At the welding portion 12*b*, an annular retraction stopper 12*d* for suppressing retraction of the stick-shaped cosmetic material container 10 is provided at a position behind the tip end side annular portion 12*c* and behind the rear end portion of the container main body 4. The retraction stopper 12*d* may or may not be in contact with the stick-shaped cosmetic material container 10.

At the welding portion 12*b*, a notch 12*e* for unsealing the packaging body 12 is provided behind the retraction stopper 12*d*, as in the second embodiment.

According to the third embodiment configured as described above, as in the first embodiment, since the stick-shaped cosmetic material container 10 is sealed at the welding portion 12*b* of the film 12*a*, the stick-shaped cosmetic material container 10 can be sold or served without a cap, and the number of parts can be reduced, which is ecological. In addition, since the opening 1*a* side of the tip end of the stick-shaped cosmetic material container 10 is sealed with the tip end side annular portion 12*c* of the welded portion 12*b* of the film 12*a*, high airtightness can be maintained until unsealing. Further, when the packaging body 12 is unsealed and the stick-shaped cosmetic material container 10 is taken out and used, the previously used cap can be reused, which is ecological. When unsealing the packaging body 12, the notch 12*e* may not be provided, and unsealing may be performed from anywhere on the welding portion 12*b*, for example, with scissors or the like.

As described in the first embodiment, since the welding portion 12*b* of the film 12*a* has the annular retraction stopper 12*d* that suppresses the retraction of the stick-shaped cosmetic material container 10 behind the tip end side annular portion 12*c*, the push-back of the stick-shaped cosmetic material container 10 rearward can be suppressed, and the opening 1*a* side of the tip end of the stick-shaped cosmetic material container 10 can be reliably sealed.

As described in the second embodiment, since the notch 12*e* for unsealing the packaging body 12 is provided behind the retraction stopper 12*d*, when replacing the stick-shaped cosmetic material container 10 with the stick-shaped cosmetic material container 10 in the unopened packaging body 12 for the purpose of changing the color of the stick-shaped cosmetic material M, or the like, the stick-shaped cosmetic material container 10 is inserted into the unsealed packaging body 12. Accordingly, the retraction of the stick-shaped cosmetic material container 10 can be suppressed by the retraction stopper 12*d* while securing airtightness and the retraction stopper 12*d* can be used instead of a cap.

FIG. 5 is a longitudinal sectional view showing a cosmetic container package 100 according to the fourth embodiment of the present disclosure.

The first difference between the fourth embodiment and the third embodiment is that, as shown in FIG. 5, instead of the container main body 4 elongated in the axial direction of the third embodiment, a container main body 5 short in the axial direction is used as a mini-type stick-shaped cosmetic material container 20.

The second difference between the fourth embodiment and the third embodiment is that, as in the first embodiment, the annular retraction stopper 12*d* positioned behind the container main body 4 for suppressing the retraction of the stick-shaped cosmetic material container 20 is replaced with a rear end side annular portion (annular retraction stopper) 12*f* disposed at a position overlapping the flange portion 1*d* in the axial direction behind the flange portion 1*d* of the tip tube 1, and the notch 12*e* for unsealing the packaging body 12 is replaced with a notch 12*g* disposed at a position where the rear end portion of the stick-shaped cosmetic material container 20 can be exposed behind the rear end side annular portion 12*f*.

According to the fourth embodiment configured as described above, the same actions and advantages as those of the third embodiment are obtained. That is, since the stick-shaped cosmetic material container 20 is sealed at the welded portion 12*b* of the film 12*a*, the stick-shaped cosmetic material container 20 can be sold without a cap, and the number of parts can be reduced, which is ecological. In addition, since the opening 1*a* side of the tip end of the stick-shaped cosmetic material container 20 is sealed with the tip end side annular portion 12*c* of the welded portion 12*b* of the film 12*a*, high airtightness can be maintained until unsealing. Further, when the packaging body 12 is unsealed and the stick-shaped cosmetic material container 20 is taken out and used, the previously used cap can be reused, which is ecological. When unsealing the packaging body 12, the notch 12*g* may not be provided, and unsealing may be performed from anywhere on the welding portion 12*b*, for example, with scissors or the like.

Since the welding portion 12*b* of the film 12*a* has the rear end side annular portion 12*f* that suppresses the retraction of the stick-shaped cosmetic material container 20 behind the tip end side annular portion 12*c*, the push-back of the stick-shaped cosmetic material container 20 rearward can be suppressed, and the opening 1*a* side of the tip end of the stick-shaped cosmetic material container 20 can be reliably sealed.

Since the notch 12*g* for unsealing the packaging body 12 is provided behind the rear end side annular portion 12*f*, when replacing the stick-shaped cosmetic material container 20 with the stick-shaped cosmetic material container 20 in the unopened packaging body 12 for the purpose of changing the color of the stick-shaped cosmetic material M, or the like, the stick-shaped cosmetic material container 20 is inserted into the unsealed packaging body 12. Accordingly, the retraction of the stick-shaped cosmetic material container 20 can be suppressed by the rear end side annular portion 12*f* while securing airtightness, and the unsealed packaging body can be used as a cap for the stick-shaped cosmetic material container 20. In addition, since the notch 12*g* is provided at a position where the rear end portion of the stick-shaped cosmetic material container 20 can be exposed behind the rear end side annular portion 12*f*, the rear end portion of the stick-shaped cosmetic material container 20 can be exposed from the unsealed packaging body 12, it is easy to grasp and easy to take in and out the stick-shaped cosmetic material container 20 with respect to the unsealed packaging body 12 that serves as a cap.

In the mini-type stick-shaped cosmetic material container 20, the stick-shaped cosmetic material M can be fed and used for application even as it is. However, it is also possible to detachably mount a holder tube having a bottomed cylindrical shape elongated in the axial direction to the container body 5 by screwing and using a male screw projection 5*a* provided on the outer peripheral surface of the container body 5, and to improve usability during drawing.

Although the present disclosure has been specifically described based on the embodiments, the present disclosure is not limited to the above embodiments, and various modifications are possible.

What is claimed is:

1. A cosmetic container package comprising:

a stick-shaped cosmetic material container that accommodates a stick-shaped cosmetic material inside and allows the stick-shaped cosmetic material to come out from an opening provided at a tip end; and a packaging body that sandwiches and packages the stick-shaped cosmetic material container with a film, wherein the packaging body includes a welding portion that seals the stick-shaped cosmetic material container up to a vicinity of an outer periphery by welding the film together, wherein the welding portion further includes a tip end side annular portion that annularly adheres to the outer periphery of the stick-shaped cosmetic material container in the vicinity of the opening, and wherein a rear end portion of the stick-shaped cosmetic material container is spaced apart from the welding portion of the packaging body.

2. The cosmetic container package according to claim 1, wherein the welding portion of the film includes an annular retraction stopper that suppresses retraction of the stick-shaped cosmetic material container behind the tip end side annular portion.

3. The cosmetic container package according to claim 2, wherein the stick-shaped cosmetic material container is provided with an annular flange portion protruding along a peripheral direction from an outer peripheral surface behind the tip end side annular portion, and wherein the retraction stopper is provided as a rear end side annular portion at a position overlapping the flange portion in an axial direction behind the flange portion.

4. The cosmetic container package according to claim 3, wherein a tail plug is provided at a rear end of a stick-shaped cosmetic material hole of the stick-shaped cosmetic material container through which the stick-shaped cosmetic material passes, the tail plug being configured to detachably close the stick-shaped cosmetic material hole, and wherein a notch for unsealing the packaging body is provided at a position where a rear end portion of the stick-shaped cosmetic material container is exposable behind the rear end side annular portion.

5. The cosmetic container package according to claim 1, wherein the stick-shaped cosmetic material container includes a container main body having a built-in feeding mechanism for feeding the stick-shaped cosmetic material.

6. The cosmetic container package according to claim 5, wherein the welding portion of the film includes an annular retraction stopper that suppresses retraction of the stick-shaped cosmetic material container behind the tip end side annular portion, and wherein a notch for unsealing the packaging body is provided behind the retraction stopper.

7. The cosmetic container package according to claim 6, wherein the notch is provided at a position where a rear end portion of the stick-shaped cosmetic material container is exposable.

* * * * *